United States Patent [19]

Jacobsson

[11] Patent Number: 4,607,507

[45] Date of Patent: Aug. 26, 1986

[54] YARN-FEEDING APPARATUS FOR A CIRCULAR KNITTING MACHINE

[75] Inventor: Kurt A. G. Jacobsson, Ulricehamn, Sweden

[73] Assignee: Aktiebolaget IRO, Ulricehamn, Sweden

[21] Appl. No.: 815,300

[22] PCT Filed: May 24, 1983

[86] PCT No.: PCT/EP83/00131

§ 371 Date: Jan. 25, 1984

§ 102(e) Date: Jan. 25, 1984

[87] PCT Pub. No.: WO83/04273

PCT Pub. Date: Dec. 8, 1983

Related U.S. Application Data

[63] Continuation of Ser. No. 584,436, Jan. 25, 1984, abandoned.

[30] Foreign Application Priority Data

May 25, 1982 [SE] Sweden ..... 8203216
Aug. 13, 1982 [SE] Sweden ..... 8204685
Oct. 4, 1982 [SE] Sweden ..... 8205657

[51] Int. Cl.[4] ..... D04B 15/43; D04B 35/16

[52] U.S. Cl. ..... 66/132 T; 66/163; 242/36

[58] Field of Search ..... 66/132 T, 161, 163, 66/165, 132 R; 242/36

[56] References Cited

U.S. PATENT DOCUMENTS 3,264,845 8/1966 Rosen ..... 66/132 T
3,950,966 4/1976 Di Carlo ..... 66/132 T
4,259,852 4/1981 Jacobsson ..... 66/132 T
4,267,554 5/1981 Loepfe et al. ..... 66/163 X
4,386,508 6/1983 Jacobsson ..... 66/132 T

FOREIGN PATENT DOCUMENTS 28412 5/1981 European Pat. Off. .
2156614 5/1973 Fed. Rep. of Germany ..... 66/163
425845 4/1975 U.S.S.R. ..... 242/36

*Primary Examiner*—Wm. Carter Reynolds
*Attorney, Agent, or Firm*—Flynn, Thiel, Boutell & Tanis

[57] ABSTRACT

A yarn-feeding apparatus for the positive feeding of several yarns to a circular mechanism of a circular knitting machine, comprising fingers which are arranged in the circular mechanism for receiving and guiding the yarn into a knitting position or taking the yarn out of a knitting position, including delivery apparatus with each including a yarn-transporting element and a yarn-guiding element which is movable back and forth between a feeding area in which the yarn is in engagement with the yarn-transporting element and a nonfeeding area, and wherein for each yarn-guiding element there is provided an electric position sensor which produces an electric signal in dependence on the position of the yarn-guiding element. Yarn errors, which would lead to damage in the finished goods if the knitting machine is not timely turned off, are detected by each position sensor always producing a feeding-area signal when the yarn-guiding element is in the feeding area or a nonfeeding-area signal when the yarn-guiding element is in the nonfeeding area. The position sensor is connected signal-transmittingly to an electric logic switching circuit for turning off the knitting machine, which circuit reacts to a combination from the signals of all position sensors, which combination represents a yarn breakage and/or a yarn overfeed and/or a yarn-changing error.

14 Claims, 4 Drawing Figures

YARN-FEEDING APPARATUS FOR A CIRCULAR KNITTING MACHINE

This application is a continuation of U.S. Ser. No. 584,436 filed Jan. 25, 1984, now abandoned.

FIELD OF THE INVENTION

The invention relates to a yarn-feeding apparatus, such as for a circular knitting machine, which can evaluate a combination of fault signals to effect shut down of the machine when predetermined fault conditions are determined.

BACKGROUND OF THE INVENTION

In a yarn-feeding apparatus of this type, which is known from European Patent Application No. EPA 80 10 6719 and its corresponding U.S. application Ser. No. 269,061 as filed May 18, 1981, now U.S. Pat. No. 4,386,508, the yarn-guiding elements are moved into nonfeeding areas by magnets, while their movement into feeding areas is effected by increased yarn tensions caused by the operation of the fingers in the circular mechanism. However, yarn-feeding apparati are also known in which the movement of the yarn-guiding elements is effected exclusively by tension changes in the yarn caused by the operation of the fingers of the circular mechanism. Each yarn-transporting element is a constantly driven belt which runs over a freely rotatable roller. As soon as the yarn-guiding element moves the yarn under the belt, same carries along the yarn and moves it to the associated finger. Vice versa during a movement of the yarn-guiding element into the nonfeeding area, the yarn is moved out from under the belt and stops. In the lastmentioned conventional yarn-feeding apparatus, it is necessary that the path of movement of the guiding elements is sufficiently long so that the yarn-guiding element compensates for unavoidable trailing movement of the yarn, which movement results due to the inertia of the yarn mass and the yarn elasticity, when the earlier effective acceleration is suddenly reduced by the yarn-transporting element. The position sensor which is connected with the yarn-guiding element emits a signal which indicates a yarn breakage in an end position of the yarn-guiding element in the nonfeeding area, which end position can be reached by the yarn-guiding element only when in addition to the normal trailing movement due to the yarn breakage the yarn-guiding element was able to move on. The knitting machine is turned off with this signal. In all other positions in the nonfeeding area and in the feeding area, the position sensor does not emit a signal. It is thereby disadvantageous that a signal cannot be produced with the position sensor when a yarn error occurs for which the knitting machine does not use the amount of yarn fed to it in an orderly manner, for example due to an interference in the path of the yarn to the circular mechanism and to the knitting needles or because of dirty yarn eyelets or an incorrect knitting machine adjustment. During such errors, the tension in the yarn which comes from the yarn-feeding apparatus is reduced, which causes the guiding element to move the yarn out of the feeding area, but without thereby reaching its end position. Shortly thereafter the yarn tension again increases, since the positive feed was ended, which causes the yarn-guiding element to move the yarn again into the feeding area. The position sensor does not react to this yarn error; rather, the guide element can reach its end position in which a shut-off signal is produced by the position sensor when the voltage in the in-feeding yarn decreases slowly, if such yarn was not processed for a longer period of time and due to vibrations or air streams starts to sag. Such an error is then difficult to find, in particular if the contact function of the position sensor is not particularly sensitive, and can cause a considerable standstill time for the knitting machine. A further yarn error exists when in the circular mechanism, after a color change, two yarns are processed simultaneously. This yarn error is also not indicated by the position sensor, since it does not reach its end position.

A basic purpose of the invention is to provide a yarn-feeding apparatus of the abovementioned type which, in response to actual and serious yarn errors, reliably and quickly turns off the knitting machine.

Each yarn-guiding element produces in the construction a signal when the yarn comes into engagement with the transporting element or out of engagement with the transporting element, and does not wait until the end position. The signals which are emitted by all position sensors and which are processed in the logic switching circuit form in the various operating conditions different signal combinations, from which the logic switching circuit can detect whether or not an error condition exists which requires the knitting machine to be turned off. The processing of the signals and the evaluation of the signal combination involves the recognition that, during orderly operation with no yarn breakage or yarn error, only one single yarn may be processed, which must then be fed positively, so that more than one positively fed yarn and also no positively fed yarn at all can only mean a yarn error. Incorrect errors are ignored, since it is of no importance for the signal emission of the positive sensor whether the yarn-guiding element is in the end position or not, because of suitable signal is already being formed as soon as the yarn moves out of or into the area of engagement of the transporting element. Due to the fact that, in this relatively narrow range between positive feed and no feed, the signal change of the position sensor is effected, it is possible to form with all provided position sensors practically delay-free combinations out of such signals, which in certain combinations are representative of a yarn error, and due to this the switching unit then quickly stops the knitting machine suddenly so that damage in the goods is kept as small as possible. When in a knitting machine which is equipped with such a yarn-feeding apparatus an orderly color change takes place with an overlap during which two yarns are processed simultaneously, then the knitting machine, does not not need to be turned off since no actual yarn error exists. No significant measures are needed for this. It is only important that the type and manner of forming signals by the position sensors makes it possible for the switching circuit to recognize actual errors immediately in connection with the help of the signal combinations and to turn off the knitting machine.

BRIEF DESCRIPTION OF THE DRAWINGS

Embodiments of the invention will be discussed hereinafter in connection with the drawings, in which.

DETAILED DESCRIPTION

Figure 1:
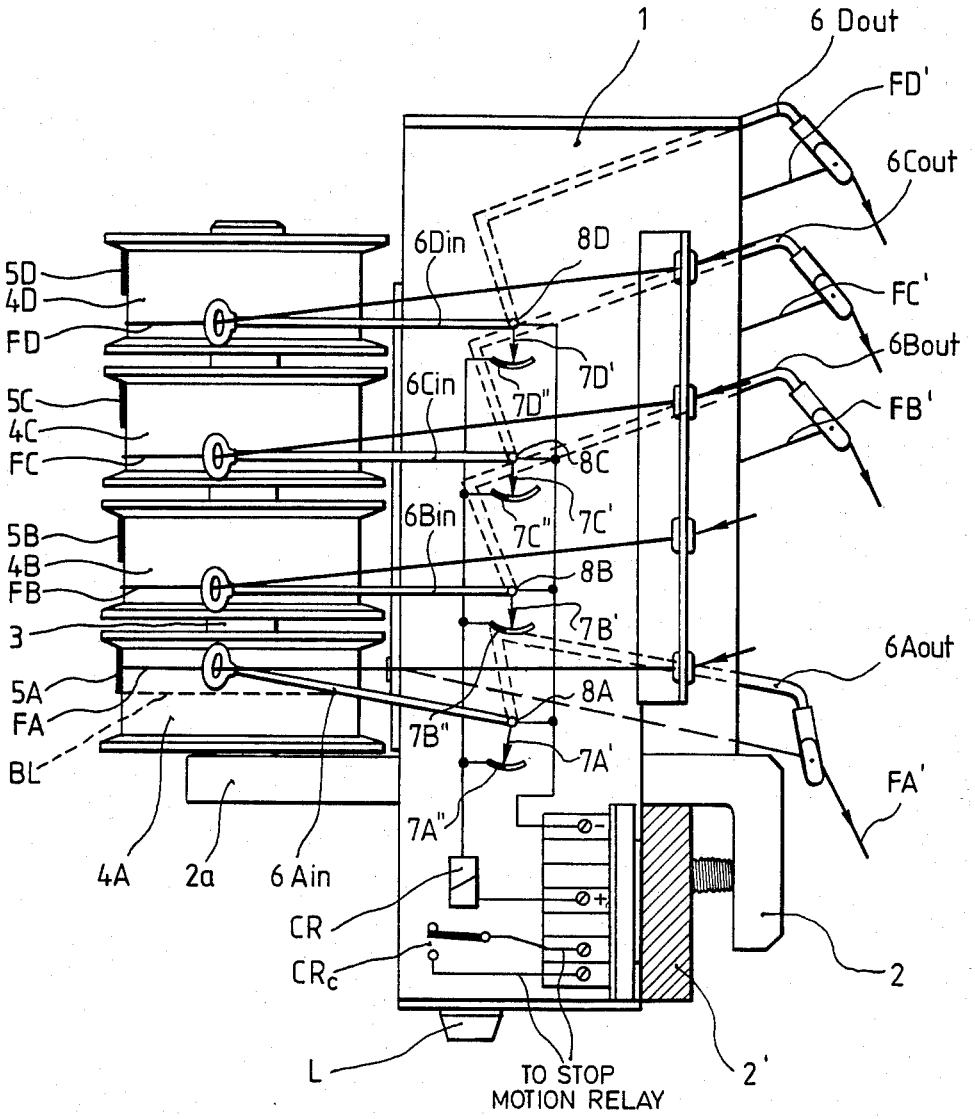
FIG. 1 is a schematic side view of a yarn-feeding apparatus.

According to FIG. 1, a yarn-feeding apparatus has a housing 1 on which is mounted a clamp portion, with which the yarn-feeding apparatus can be secured on a circular support ring 2' above an associated knitting station in a horizontal circular knitting machine. In a multi-system circular knitting machine there are provided as many yarn-feeding devices as there are knitting stations in the knitting machine. The clamp portion 2 extends partly in and partly below the housing 1 and has a support plate 2a for a vertical axle 3, on which four yarn-feeding wheels 4A,4B,4C and 4D are supported freely rotatably, namely one above the other. A portion of the circumference of each yarn-feeding wheel has a yarn-transporting element formed as a belt 5A,5B,5C,5D engaging it. The belts are driven in a conventional manner in synchronism with the knitting machine in order to supply in this case four yarns FA,FB,FC,FD which come from not illustrated yarn spools. The yarns are then fed, preferably through guide eyelets, to the fingers in a circular mechanism (not illustrated), from where they then run to the knitting needles in the knitting machine.

Yarn-feeding guiding elements 6Ain,6Bin,6Cin,6Din and 6Aout,6Bout,6Cout,6Dout are pivotally supported in pairs on the housing 1, wherein an input-guiding element 6Ain, 6Bin,6Cin,6Din and a respective output-guiding element 6Aout,6Bout,6Cout,6Dout which is fixedly connected therewith is provided for each yarn FA,FB,FC,FD.

Each input-guiding element 6Ain,6Bin,6Cin,6Din can be pivoted back and forth, against the force of a spring (not illustrated) which urges it counterclockwise, between a feeding area and a nonfeeding area, as can the output-guiding elements 6Aout,6Bout,6Cout,6Dout. When the yarn-feeding element of a yarn is in a feeding-area position, the yarn lies under the belt and is positively fed by same, whereas when the yarn-feeding element for a yarn is in the nonfeeding-area position, the yarn lies outside of the region of engagement of the belt and feeding wheel and is no longer fed.

In FIG. 1 the input-guiding element 6Ain and the output-guiding element 6Aout are in the feeding-area position, so that the yarn FA is fed positively, while the other yarn-feeding elements are in their nonfeeding-area positions, so that the other yarns FB,FC,FD are not fed.

The yarn-guiding elements are supported in the housing 1 on shafts 8 which extend perpendicular with respect to the drawing plane (FIG. 1). A contact pin 7A',7B',7C',7D' is connected to each shaft, which pin together with a correspondingly arranged contact plate 7A",7B",7C",7D" forms an electric position sensor for sensing the position of the associated yarn-guiding element.

The contact plates 7A",7B",7C",7D" in this exemplary embodiment according to FIG. 1 are each conductive only in the left portion thereof and are nonconductive in the right portion thereof. In this manner, the position sensor emits a signal when the associated yarn-guiding element is in the feeding-area position, while in the nonfeeding-area position no signal is produced. Of course, this arrangement could also be reversed. The transition from the nonconductive portion to the conductive portion of each contact plate is arranged so that a signal is produced exactly when the associated yarn becomes disengaged from the belt 5A,5B,5C,5D or moves under the belt, namely the switching points of the position sensors lie exactly in the threshold regions in which a positive delivery of the yarn starts or stops. The respective signal is then maintained unchanged during further movement of the yarn-guiding element within the non-feeding area or the feeding area.

The contact plates 7A",7B",7C",7D" are connected by a connecting line to a control relay CR, which on the other hand is connected to a positive voltage source in the housing 1. The contact pins 7A',7B',7C',7D' are connected by a common line to a negative voltage source, also in the housing 1. The control relay CR has its relay contacts $CR_c$ connected in a circuit which includes the stop-motion relay of the knitting machine. The stop-motion relay, for example, turns off the knitting machine when it is energized. This circuit in the housing forms an electric logic switching circuit which operates in the aforementioned manner and switches off the knitting machine when all position sensors produce specific signal combinations which will be explained later.

Figure 2:
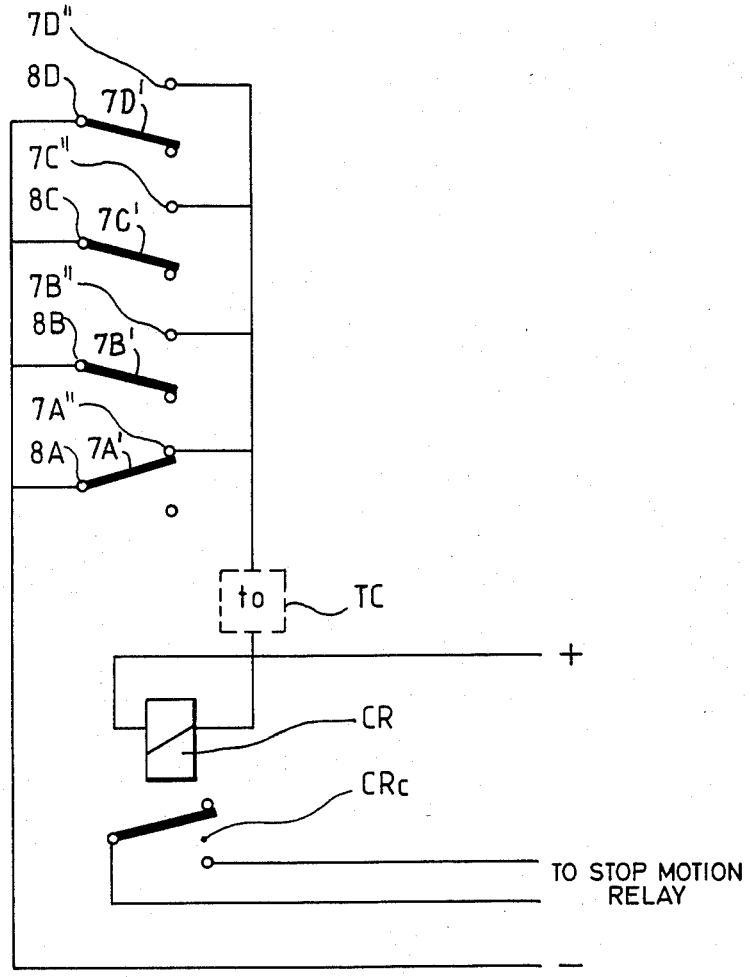
FIG. 2 illustrates a first embodiment of an electric circuit of the yarn-feeding apparatus of FIG. 1.

FIG. 2 illustrates a circuit which can be used in the yarn-guiding apparatus of FIG. 1 wherein, if desired, a time element of a timer circuit TC with a time delay of $t_o$ is provided before the control relay CR. The positions of the contact pins 7A',7B',7C',7D' and the shafts 8A,8B,8C,8D of the yarn-guiding elements corresponds with the position shown in FIG. 1.

During a normal and orderly operation of the yarn-feeding apparatus of FIG. 1, namely in the positions shown in FIG. 1, the yarn FA is fed positively. The associated contact pin 7A' engages the contact on the contact plate 7A", whereby the d.c. circuit from (−) to (+) is closed through the control relay CR and, if provided, the time element TC. This means in this circuit that the control relay CR is energized and keeps it contacts $CR_c$ open, so that the circuit for the stop-motion relay of the knitting machine is open. The knitting machine thus operates. In the case of a breakage of the yarn FA or a drop in the yarn tension due to an outside influence, the yarn-guiding element 6Aout swings upwardly and the input-yarn-guiding element 6Ain swings downwardly. The contact pin 7A' is moved to the nonconducting region of the contact plate 7A", so that the d.c. circuit through the control relay is interrupted and the control relay CR is de-energized. The contacts $CR_c$ of the control relay CR then close the circuit for the stop-motion relay of the knitting machine, so that the knitting machine is promptly stopped.

The time element TC (FIG. 2) can be provided for the case that, during a yarn change in the knitting machine, no overlapping between the old and the new yarn takes place. This time element with its time $t_o$ then bridges the short time period during which no feeding-area signal is provided.

A further yarn error (overfeed) exists if for any reason the just processed old yarn or also a new yarn is not properly processed by the knitting needles or is not forwarded properly to the knitting needles by the respective finger in the circular mechanism. The position sensor for this yarn will produce, due to the reduction in yarn tension which occurs during this yarn error, a nonfeeding-area signal, or in other words none of the position sensors will produce a feeding-area signal. The logic switching circuit reacts to this signal combination and operates the stop-motion relay, which causes the knitting machine to be turned off immediately.

A further yarn error exists if, after a yarn change, the old yarn, which should not be further processed, still remains tensioned, for example because in the circular mechanism or in front of the knitting needle cutting was not done correctly. Then, the old yarn is processed at the same time as the new yarn, namely, both yarns are fed positively. In this case, the knitting machine is supposed to be turned off. This occurs in the embodiments according to FIGS. 3 and 4 by the electronic switching circuit (indicated at A in FIG. 3 and by dashes in FIG. 4) recognizing a signal combination from the position sensors which indicates the yarn-error condition and subsequently turning off the knitting machine.

Figure 3:
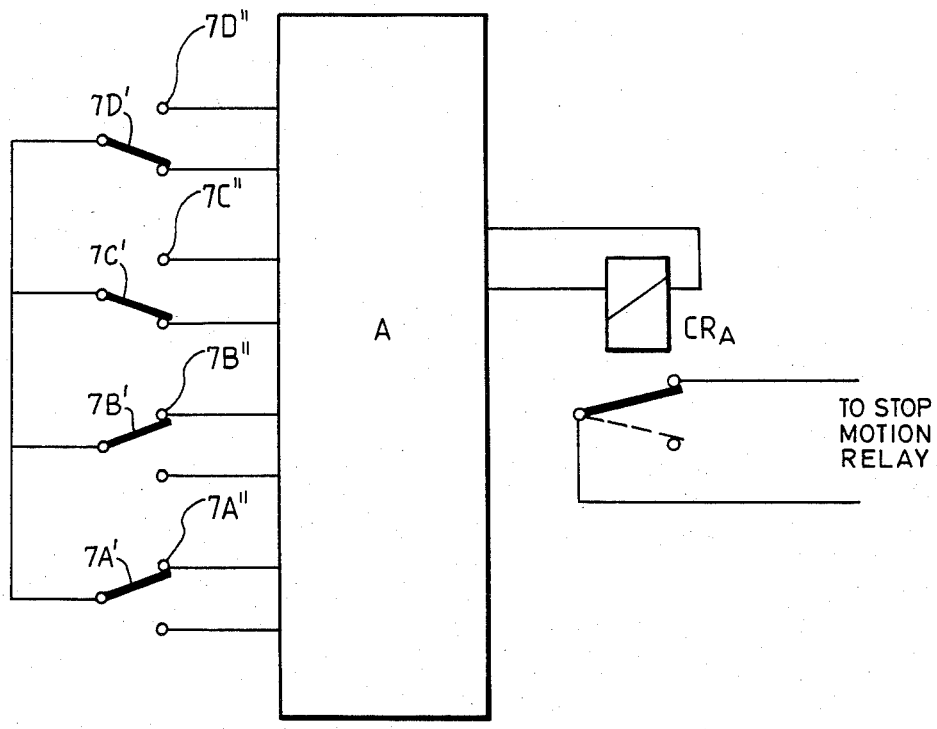
FIG. 3 illustrates a second embodiment of the electric circuit.

According to FIG. 3, the contact plates 7A",7B",7C",7D" are connected with a number of input connections of an electronic logic switching circuit A, which is created for example from common electronic logic components (as in FIG. 4) or is formed by a microprocessor. The output of the logic switching circuit A is connected with the coil of a control relay $CR_A$, the relay contacts of which lie in a circuit controlling the stop-motion relay of the knitting machine.

The electronic logic switching circuit A is designed so that it produces an output signal for switching the control relay $CR_A$ in response to two error conditions which are represented by specific signal combinations, which causes the stop-motion relay of the knitting machine to be operated.

The first error condition consists of n nonfeeding-area signals from the position sensors 7A',7A",7B',7B", 7C',7C",7D',7D", where n is the number of position sensors. This combination of n-signals indicates that yarn is not being knitted or that the yarn intended for knitting is broken.

The second error condition is indicated by a signal combination which consists of (n minus a number greater than 1) signals, where n is the number of existing position sensors. In other words, a signal combination which indicates more than one feeding-area signal exists simultaneously with nonfeeding-area signals illustrates this error condition, during which for example two yarns are being knitted simultaneously.

It is possible to design the logic switching circuit for both error conditions so that it produces an output signal for the stop-motion relay of the knitting machine with a specific time delay, for example 20 milliseconds, thereby avoiding an erroneous turning off of the knitting machine during a yarn change. During a yarn change with an overlap two yarns are simultaneously fed positively for a short period of time, while during a yarn change without overlap no yarn at all is fed for a certain time span because the old yarn is no longer being fed and the new yarn is not yet being fed.

Figure 4:
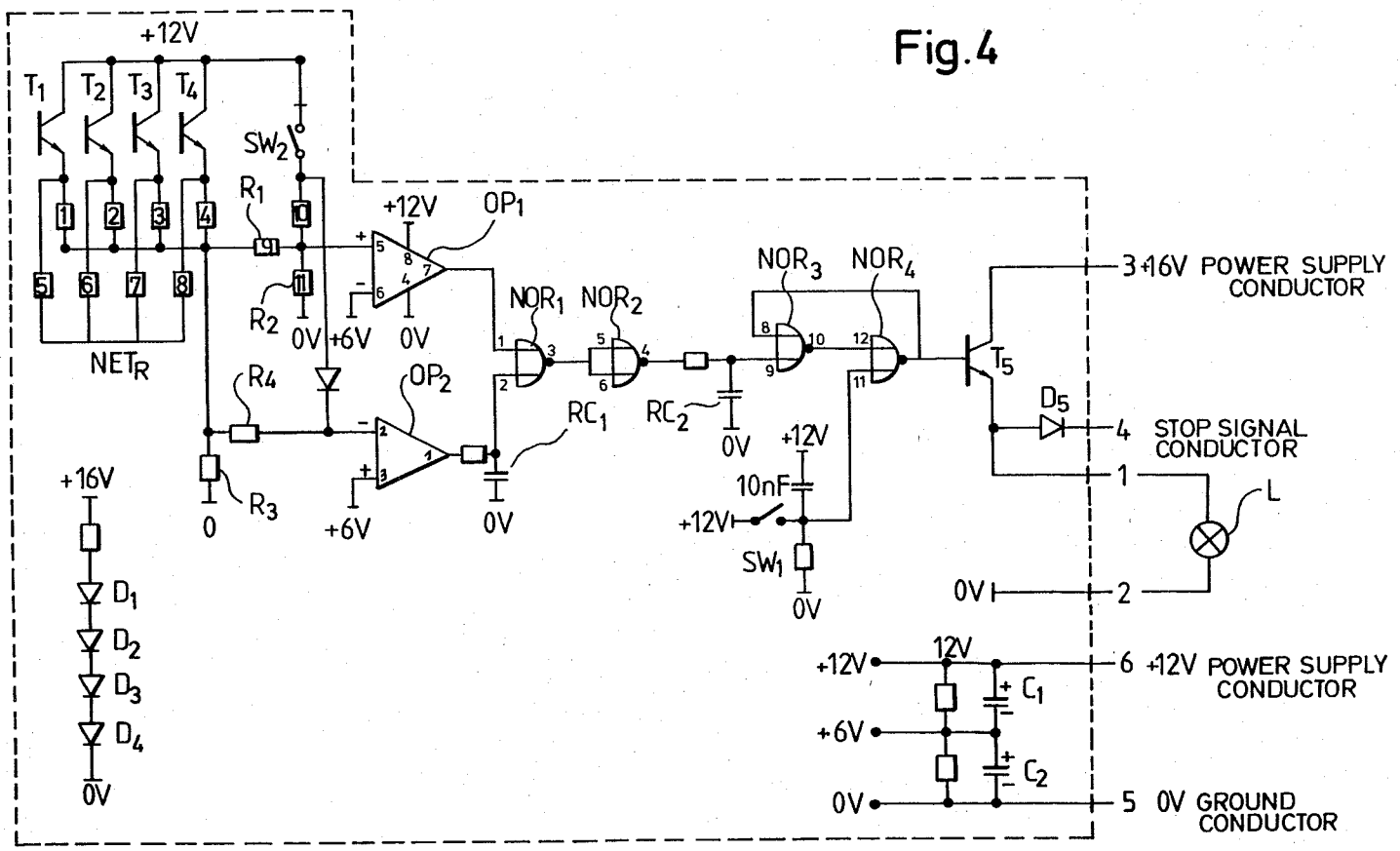
FIG. 4 illustrates a further embodiment of the electric circuit.

In the embodiment of FIG. 4, the position sensors are constructed by four phototransistors T1 to T4 and four photodiodes D1 to D4 as opto-electronic position sensors for the yarn-guiding elements. The emitters of the phototransistors T1 to T4 are connected through a resistor network $NET_r$ to an input of a first operational comparator or amplifier $OP_1$ and to an input of a second operational comparator or amplifier $OP_2$. The other, negative input of the operational amplifier $OP_1$ is supplied with a reference voltage value. The other, positive input of the operational amplifier $OP_2$ is also supplied with a reference voltage. The output of the first operational amplifier $OP_1$ is connected to an input of a first NOR-gate $NOR_1$. The output of the second operational amplifier $OP_2$ is connected by an intermediate resistor and a second timer circuit $RC_1$ to the second input of the first NOR-gate $NOR_1$, wherein the time circuit $RC_1$ has for example a time constant of approximately 140 milliseconds. The output of the first NOR-gate $NOR_1$ is applied to both inputs of a second NOR-gate $NOR_2$, the output of which is connected to a holding circuit through a second timer circuit $RC_2$. The timer circuit $RC_2$ has for example a time constant of approximately 60 milliseconds. The holding circuit is an S-R flip-flop which consists of two NOR-gates $NOR_3$ and $NOR_4$, the output of the NOR-gate $NOR_2$ being connected through an intermediate resistor to one input of the NOR-gate $NOR_3$ of the holding circuit. The other input of the NOR-gate $NOR_3$ is connected through a feedback loop to the output of the NOR-gate $NOR_4$ of the holding circuit. The output of the NOR-gate $NOR_3$ is connected to one input of the NOR-gate $NOR_4$, while the other input of the NOR-gate $NOR_4$ is connected through a divider which includes a resistor and a capacitor to a contact of a reset switch $SW_1$. The output of the holding circuit is connected to the base of a further transistor $T_5$, which is connected through a connecting line to the stop-motion relay of the knitting machine, wherein a grounded indicating lamp L for providing a visual indication of an error condition is connected to the connecting line.

The holding circuit $NOR_3$ and $NOR_4$ holds the stop-motion relay of the knitting machine open after occurrence of an error condition and until such error condition is cancelled by operating the switch $SW_1$.

The two operational amplifiers $OP_1$, $OP_2$ and/or the NOR-gates $NOR_1$–$NOR_4$ can advantageously be contained in an integrated switching circuit of conventional construction which simplifies the manufacture of the circuit and keeps the space required for the circuit small.

A switch $SW_2$ is connected by intermediate resistors to points between the position sensors and the two operational amplifiers $OP_1$ and $OP_2$, with which switch under certain operating conditions the position sensors can be bridged. A diode is inserted in the connecting line between the switch $SW_2$ and the second operation amplifier $OP_2$.

The electronic logic switching circuit according to FIG. 4 is mounted on the inside of the housing 1 of the yarn-feeding apparatus of FIG. 1. During the first aforementioned error condition, all four transistors T1 to T4 become conductive. Because of the resistors $R_1$ and $R_2$ which are placed in front of the first operation amplifier $OP_1$, a voltage level will be provided by the resistor network $NET_R$ at one input of the first operation amplifier $OP_1$, so that its output also emits a high voltage level or voltage potential which as a signal corresponds with a binary 1. If this high voltage potential is maintained for longer than 60 milliseconds, the signal finally goes through timer $RC_2$ to the base of the transistor T5, which causes said transistor to become conductive and to send a shut-off signal on the connecting line to the stop-motion relay of the knitting machine, which is maintained by the holding circuit $NOR_3$ and $NOR_4$ and also causes the lamp L to illuminate.

During the second error condition, only two of the four transistors T1 to T4 or less become conductive, through which due to the special design of the resistors $R_3$ and $R_4$, which are placed in front of an input of the second operational amplifier $OP_2$, a voltage level is fed to one input of the second operational amplifier $OP_2$. The first operational amplifier $OP_1$ is designed so that it does not react to this voltage level. As a result the operational amplifier $OP_2$ emits a high potential at its output which is fed through the timer circuit $RC_1$ to the second input of the NOR-gate $NOR_1$. When the high potential of the output of the second operation amplifier $OP_2$ exists longer than 140 milliseconds for timer RC, 60 milliseconds for timer $RC_2$ equalling 200 milliseconds, then the base of the transistor T5 receives a voltage potential, based on which the transistor T5 becomes conductive and produces a shut-off signal.

The invention is not limited to the earlier discussed exemplary embodiments. These exemplary embodiments are only to facilitate an understanding of the inventive thought to produce a signal from the yarn movement between the feeding area and the nonfeeding area exactly in the transition area from the positive feed to no feed, and to produce signal combinations from the signals which depend on the positions of the other yarns, which signal combinations represent exactly the existence of error conditions for which the knitting machine is to be turned off. It is thereby of subordinate importance how the turning off of the knitting machine is actually done. It can be chosen advantageously, depending on how the signals are evaluated by the position sensors, whether the respectively fed yarn or the just not fed yarns are monitored, namely each feeding-area signal will then be a positive signal (for example a binary 1), while the nonfeeding-area signals are negative signals (for example binary 0), or vice versa. It is preferred for various reasons to thereby give a check of the just not fed yarns.

I claim:

1. In a yarn-feeding apparatus for positive feeding of plural yarns to a circular mechanism of a circular knitting machine, in particular a multi-system circular knitting machine, including fingers which are arranged movable in the circular mechanism for selectively and successively receiving and guiding the yarn into a knitting position or for taking the yarn out of a knitting position, a plurality of yarn delivery devices which in number correspond with the number of yarns, each said yarn delivery device having a yarn-transporting element and a yarn-guiding element which can be moved back and forth in response to yarn tension between a feeding position in which the yarn is in driving engagement with the yarn-transporting element and a nonfeeding position in which the yarn is free of driving engagement with the yarn-transporting element, and an electric position sensor means associated with each yarn-guiding element for producing a signal in dependence on the position of the yarn-guiding element, comprising the improvement wherein each said position sensor means provides a first signal when the yarn-guiding element is in the feeding position and provides a second signal when the yarn-guiding element is in the nonfeeding position, the first and second signals being different from one another, and an electric logic switching circuit for turning off the knitting machine, said switching circuit being connected for receiving the signals from all of the position sensor means, said switching circuit including a fault condition sensing means for receiving and evaluating the combination of signals as received from all of said position sensor means for sensing a first fault condition caused by a yarn breakage or misfeed and a second fault condition caused by a yarn changing fault such that two yarns are being fed simultaneously, said fault condition sensing means including means for receiving and evaluating first and second said combinations of signals which are distinctively different from one another and respectively indicate said first and second fault conditions, and said switching circuit having switch means for shutting off the knitting machine upon sensing any one of said faults.

2. A yarn-feeding apparatus according to claim 1, wherein said fault condition sensing means can sense the presence of two or more said first signals within said combination of signals so that said switching circuit shuts down the knitting machine due to a yarn-changing fault.

3. A yarn-feeding apparatus according to claim 2, wherein said fault condition sensing means can sense the complete absence of any said first signals within said combination of signals so that the switching circuit shuts down the machine due to a yarn breakage or a yarn overfeed.

4. An apparatus according to claim 1, wherein the combination of signals includes a number of signals n, wherein n is an integer greater than 1 and corresponds to the number of said position sensor means.

5. An apparatus according to claim 1, wherein said switching circuit converts the signals of the position sensor means into a voltage level which is proportional to the number of said first or second signals, but not the combined total of both.

6. An apparatus according to claim 5, wherein the fault condition sensing means includes comparator means which detects the existence of a fault condition by comparing said voltage level with a reference voltage.

7. An apparatus according to claim 6, wherein said comparator means includes first and second comparators which each detect the existence of a different fault condition by comparing the voltage level with a reference voltage.

8. An apparatus according to claim 3, wherein said fault condition sensing means includes first comparator means for detecting when the combination of signals consists solely of said second signals, and second comparator means for detecting when said combination of signals include a least two of said first signals, said switch means being responsive to an output from said comparator means for shutting off the knitting machine.

9. An apparatus according to claim 8, wherein said circuit converts said first or said second signals to a voltage level which is proportional to the number of such signals, said first comparator means comprising said voltage level to a first reference voltage for permitting activation of said switch means when said voltage level exceeds said first reference voltage, said second comparator means comparing said voltage level to a second reference voltage for permitting activation of said switch means when said voltage level is less than said second reference voltage, and time delay means associated with said second comparator means for delaying activation of said switch means for a predetermined time after said second comparator means senses said voltage level exceeding said second reference voltage.

10. An apparatus according to claim 9, including a further time means associated with said first comparator means for delaying the activation of said switch means when said first comparator means senses said voltage level exceeding said first reference voltage, the time delay of said further timer means being less than the time delay of said time delay means.

11. In a yarn-feeding apparatus for positive feeding of plural yarns to a circular mechanism of a circular knitting machine, in particular a multi-system circular knitting machine, including fingers which are arranged movably in the circular mechanism for selectively and successively receiving and guiding the yarn into a knitting position or for taking the yarn out of a knitting position, a plurality of yarn delivery devices which in number correspond with the number of yarns, each said yarn delivery device having a yarn-transporting element and a yarn-guiding element which can be moved back and forth in response to yarn tension between a feeding position in which the yarn is in driving engagement with the yarn-transporting element and a nonfeeding position in which the yarn is free of driving engagement with the yarn-transporting element, and a position sensor means associated with each said yarn-guiding element for producing a determined signal in dependence on the position of the yarn-guiding element, said sensor means producing said determined signal only when the respective yarn-guiding element is in one of said positions but not in the other of said positions, the improvement comprising:

control circuitry means for receiving a combination of all said determined signals as provided by all said sensor means for evaluating said combination for determining if one of plural yarn-fault conditions exists and for shutting down the knitting machine if one of said conditions does exist;

said control circuit means including switching means for shutting off said knitting machine, first means for evaluating the combination of signals for determining when all of the yarn-guiding elements are in said nonfeeding position for signaling said switching means to shut off said machine, and second means for evaluating said combination of signals for determining when at least two of said yarn-guiding elements are in said feeding position for signaling said switching means to shut off said knitting machine.

12. An apparatus according to claim 11, wherein said circuitry means includes timer means interconnected with said second means for creating a time delay of predertermined magnitude prior to activation of said switching means by said second means.

13. An apparatus according to claim 11, wherein each said sensor means produces a second signal which is different from said first-mentioned signal when in the other of said positions.

14. An apparatus according to claim 11, wherein said circuitry means includes first timer means interconnected with said first means for creating a time delay of first predetermined magnitude prior to activation of said switching means by said first means, and second timer means interconnected with said second means for creating a time delay of second predetermined magnitude prior to activation of said switching means by said second means, said second predetermined magnitude being greater than said first predetermined magnitude.

* * * * *

UNITED STATES PATENT AND TRADEMARK OFFICE

CERTIFICATE OF CORRECTION

PATENT NO. : 4 607 507

DATED : August 26, 1986

INVENTOR(S) : Kurt A. G. JACOBSSON

It is certified that error appears in the above-identified patent and that said Letters Patent is hereby corrected as shown below:

Column 8, line 45; change "include a" to ---includes at---.

Signed and Sealed this

Third Day of March, 1987

*Attest:*

*Attesting Officer*

DONALD J. QUIGG

*Commissioner of Patents and Trademarks*